US006680467B1

(12) United States Patent
Whipple, Jr.

(10) Patent No.: US 6,680,467 B1
(45) Date of Patent: Jan. 20, 2004

(54) MICROWAVE DELIVERY SYSTEM WITH MULTIPLE MAGNETRONS FOR A COOKING APPLIANCE

(75) Inventor: Robert Z. Whipple, Jr., Louden, TN (US)

(73) Assignee: Maytag Corporation, Newton, IA (US)

( * ) Notice: Subject to any disclaimer, the term of this patent is extended or adjusted under 35 U.S.C. 154(b) by 0 days.

(21) Appl. No.: 10/299,669

(22) Filed: Nov. 20, 2002

(51) Int. Cl.[7] ..... H05B 6/70

(52) U.S. Cl. ..... 219/747; 219/746; 219/697; 219/717; 219/718

(58) Field of Search ..... 219/695, 696, 219/697, 745, 746, 747, 748, 749, 750, 751, 756, 717, 718

(56) References Cited

U.S. PATENT DOCUMENTS

| | | | | |
|---|---|---|---|---|
| 2,593,067 A | | 4/1952 | Spencer | |
| 4,079,221 A | | 3/1978 | McGillem et al. | |
| 4,301,347 A | | 11/1981 | Quine | |
| 4,323,745 A | * | 4/1982 | Berggren | 219/697 |
| 4,336,434 A | | 6/1982 | Miller | |
| 4,415,789 A | | 11/1983 | Nobue et al. | |
| 4,446,349 A | | 5/1984 | Smith | |
| 4,464,554 A | | 8/1984 | Bakanowski et al. | |
| 4,477,707 A | * | 10/1984 | Kim | 219/697 |
| 4,621,179 A | | 11/1986 | Kusunoki et al. | |
| 4,870,236 A | * | 9/1989 | Berggren | 219/691 |
| 5,632,921 A | | 5/1997 | Risman et al. | |
| 5,932,131 A | | 8/1999 | Joo et al. | |
| 5,961,871 A | | 10/1999 | Bible et al. | |
| 6,066,841 A | | 5/2000 | Kim et al. | |

FOREIGN PATENT DOCUMENTS

| | | | | |
|---|---|---|---|---|
| JP | 57-124378 | | 8/1982 | |
| JP | 2-181387 | * | 7/1990 | 219/697 |
| JP | 2-250288 | * | 10/1990 | 219/697 |
| JP | 5-21152 | | 1/1993 | |
| JP | 5-89957 | | 4/1993 | |

* cited by examiner

*Primary Examiner*—Philip H. Leung
(74) *Attorney, Agent, or Firm*—Diederiks & Whitelaw, PLC

(57) ABSTRACT

A microwave delivery system for a cooking appliance includes an electronic control unit and a plurality of magnetrons arranged in a spaced relationship for the introduction of various energy fields into an oven cavity. The electronic control unit creates a phase angle shift between each of the microwave energy fields such that a constructive standing wave propagates about the oven cavity. In this manner, localized hot and cold spots, which can detrimentally affect cooking efficiency, are eliminated without the need for mode stirring or turntables. With this system, the total energy delivered to the oven cavity is the combined energy level of the various microwave energy fields.

19 Claims, 3 Drawing Sheets

MICROWAVE DELIVERY SYSTEM WITH MULTIPLE MAGNETRONS FOR A COOKING APPLIANCE

BACKGROUND OF THE INVENTION

1. Field of the Invention

The present invention pertains to the art of microwave cooking appliances and, more particularly, to a microwave cooking appliance including multiple magnetrons, each emitting a respective microwave energy field, and an electronic controller for establishing relative phase angles for the microwave energy fields.

2. Discussion of the Prior Art

Cooking appliances utilizing a directed microwave energy field to cook a food item have existed for some time. In general, a cooking process is performed by heating the food item by directing a standing microwave energy field into an oven cavity such that the microwave energy field reflects about the oven cavity and impinges upon the food item. As the microwave energy field impinges upon the food item, the field is converted into heat through two mechanisms. The first heating mechanism is caused by the linear acceleration of ions, generally in the form of salts present within the food item. The second is the molecular excitation of polar molecules, primarily water, present within the food item. However, the nature of the standing waves results in localized areas of high and low energy which cause the food to cook unevenly. This is especially true in larger ovens where the size of the cavity requires a more uniform energy distribution in order to properly cook the food. To attain an even or uniform energy distribution, the microwave energy must be introduced into the oven cavity in a manner which creates a constructive standing wave front that propagates about the oven cavity in a random fashion.

Various methods of directing microwaves into cooking chambers to minimize hot and cold areas within a food item have been proposed in the prior art. These methods range from altering the pattern of the standing waves by varying the frequency of the microwave energy field, to incorporating a stationary mode stirrer which simulates a change in the geometric space of the cooking chamber. Methods of changing the wave pattern also include the incorporation of a rotating blade stirrer which functions to reflect microwave energy into a cooking cavity in various patterns. Traditionally, stirrers have been located at various points in the microwave feed system, ranging from adjacent to a microwave energy source, to a position within the cooking chamber itself. Some stirrers include various openings which are provided to disperse the standing waves, and others have various surface configurations designed to reflect the standing waves. Stirrers are either driven by a motor or by air currents supplied by a blower. In any event, all of these methods share a common theme, i.e., to reflect and/or deflect the microwave energy into a cooking cavity such that a uniform distribution of standing wave patterns can be achieved.

Other methods of modifying the standing wave patterns include altering the design of a waveguide or path through which the microwave energy field is introduced into the oven cavity. Prior art waveguide designs include cylinders, square boxes, and a variety of other configurations designed to cause the standing waves to interfere with one another such that the wave pattern was randomized and maximum energy was directed into the oven cavity. Other designs have included matching the dimensions of the wave guide to the wavelengths of the standing wave pattern. However, as each waveguide is designed to meet the particular specification of each oven cavity, a new waveguide must be designed to accommodate each different model oven.

As oven cavities have grown in size and microwave technology has been combined into radiant and/or convection ovens, the uniform distribution of the standing waves has become of even greater concern. For this reason, manufacturers have modified their designs to include complex waveguides, multiple stirrers, motor driven, variable speed stirrers, and turntables, all of which were intended to enhance wave pattern distribution to a more uniform character. Certainly, the mechanisms which serve to alter the microwave energy field, e.g., stirring fans and turntables, add to the complexity of designs and introduce potential failure points, thus reducing the service life of such appliances.

Based on the above, there exists a need for a microwave delivery system which will function to establish a uniform standing wave pattern in an oven cavity in a cost efficient manner. More specifically, there exists a need to effectively enhance a developed microwave energy field within an oven cavity of a cooking appliance in order to eliminate, or at least substantially reduce, the existence of hot and cold spots without the additional requirement for mode stirring, rotating the food, or the like.

SUMMARY OF THE INVENTION

The present invention is directed to a microwave cooking appliance which efficiently cooks a food item placed within an oven cavity by shifting the phase angle of a plurality of microwave energy fields. The microwave cooking appliance of the present invention includes a plurality of magnetrons and an electronic control unit which initiates a phase angle shift between the microwave energy fields emitted by the magnetrons. Specifically, the phase angle shifting eliminates the presence of localized hot and cold spots by creating constructive standing wave fronts within the oven cavity. In accordance with the invention, the food item is cooked evenly without requiring complex waveguides, mode stirrers or turntables.

In accordance with one embodiment of the present invention, the plurality of magnetrons are arranged on opposing ends of the oven cavity. In a preferred form of the invention, each of the plurality of magnetrons are spaced at a distance equal to multiples of ¼ $\lambda$, where $\lambda$ is the wavelength of the particular microwave energy field. The total energy delivered to the oven cavity is the combined microwave energy fields emitted from the plurality of magnetrons. In the most preferred form of the invention, the energy from three 400 Watt magnetrons are combined to deliver a total energy field to the oven cavity in a range of between 1000–1200 Watts.

Additional objects, features and advantages of the present invention will become more readily apparent from the following detailed description of a preferred embodiment when taken in conjunction with the drawings wherein like reference numerals refer to corresponding parts in the several views.

DETAILED DESCRIPTION OF THE PREFERRED EMBODIMENT

Figure 1:
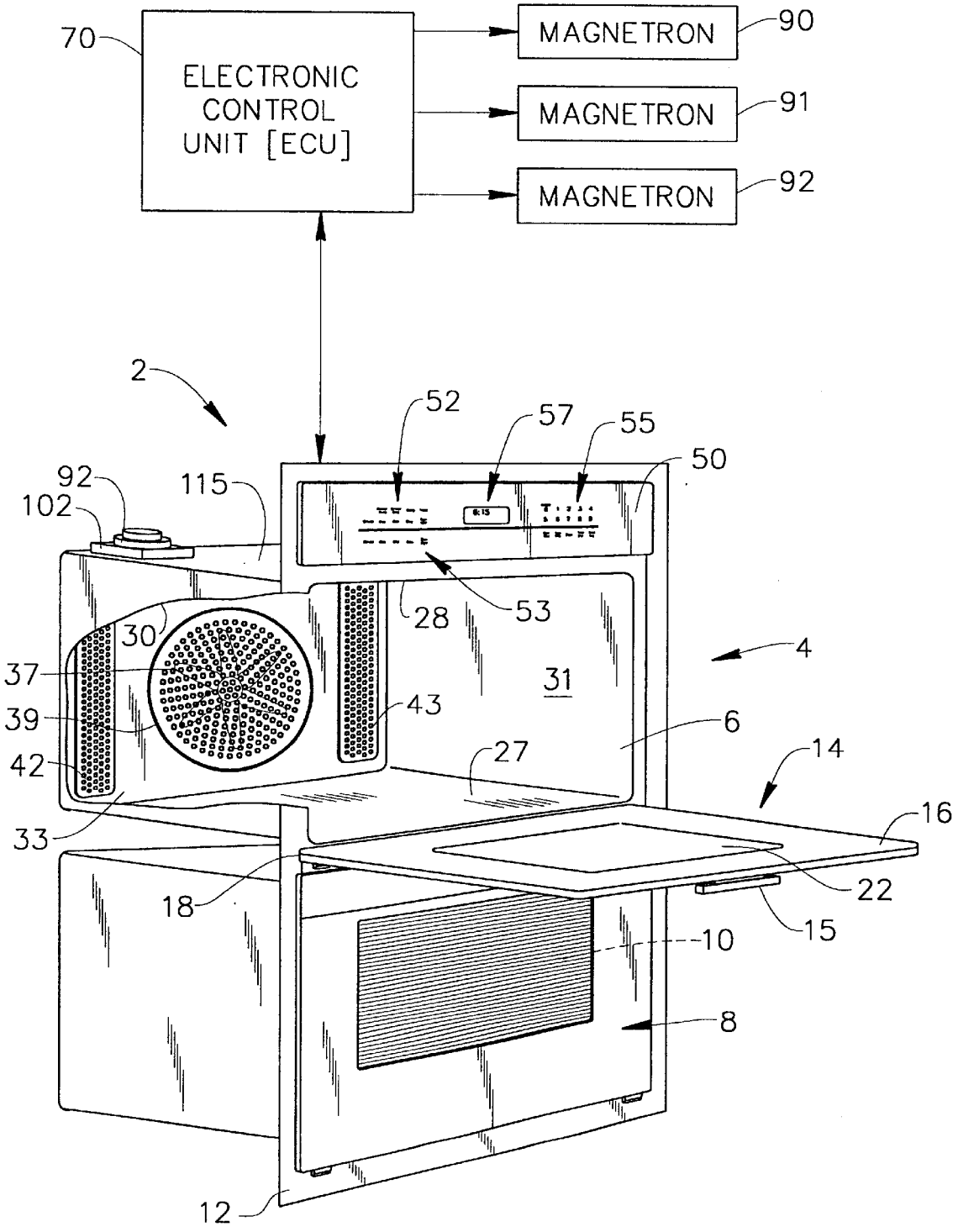
FIG. 1 is a perspective view of a microwave cooking appliance including a microwave delivery system with multiple magnetrons constructed in accordance with the present invention.

With initial reference to FIG. 1, a microwave cooking appliance constructed in accordance with the present invention is generally indicated at 2. As shown, cooking appliance 2 constitutes a dual oven wall unit which includes an upper oven 4 including upper oven cavity 6, and a lower oven 8 including a lower oven cavity 10. In accordance with the:most preferred form of the invention, upper oven 4 is designed to perform a combination microwave/convection cooking process, while lower oven 8 is provided to perform a more conventional radiant cooking operation. However, at this point, it should be realized that the invention is actually applicable to a wide range of cooking appliances, including slide-in ranges, countertop units, or the like.

In the embodiment shown, cooking appliance 2 includes an outer frame 12 for supporting upper oven cavity 6 and lower oven cavity 10. In a manner known in the art, a respective door assembly, one of which is indicated at 14, is provided to selectively access one of upper and lower oven cavities 6 and 10. As shown, door assembly 14 is provided with a handle 15 at an upper portion 16 thereof. Door assembly 14 is adapted to pivot at a lower portion 18 to enable selective access to within a respective one of oven cavities 6 and 10, In a manner also known in the art, door 14 is provided with a transparent zone 22 for viewing a respective oven cavity 6, 10 while door assembly 14 is closed.

As best seen in FIG. 1, oven cavity 6 is defined by a bottom portion 27, an upper portion 28, opposing side portions 30–31, and a rear portion 33. Bottom portion 27 is preferably constituted by a smooth flat surface in order to improve cleanability, serviceability, and the reflective qualities of oven cavity 6. In the embodiment shown, arranged on rear portion 33 is a convection fan 37 having a perforated cover 39. Fan 37 is part of the convection cooking system of cooking appliance 2 and operates in a manner generally known in the art. In general, when fan 37 is operated, air within oven cavity 6 is drawn in through cover 39 into a plenum (not shown). At least a portion of the airflow is re-introduced into oven cavity 6 through outlet vents 42 and 43.

As further shown in FIG. 1, cooking appliance 2 includes an upper control panel 50 having first and second rows of oven control elements 52 and 53 for programming, in combination with a numeric pad 55 and a display 57, particular cooking operations for upper and lower ovens 4 and 8 respectively. Since the general programming and operation of cooking appliance 2 is known in the art and does not form part of the present invention, these features will not be discussed further here. Instead, the present invention is particularly directed to an electronic control unit 70 and the incorporation of a plurality of microwave emitters or magnetrons 90–92 for establishing a controlled microwave energy field for cooking in oven cavity 6.

Figure 2:
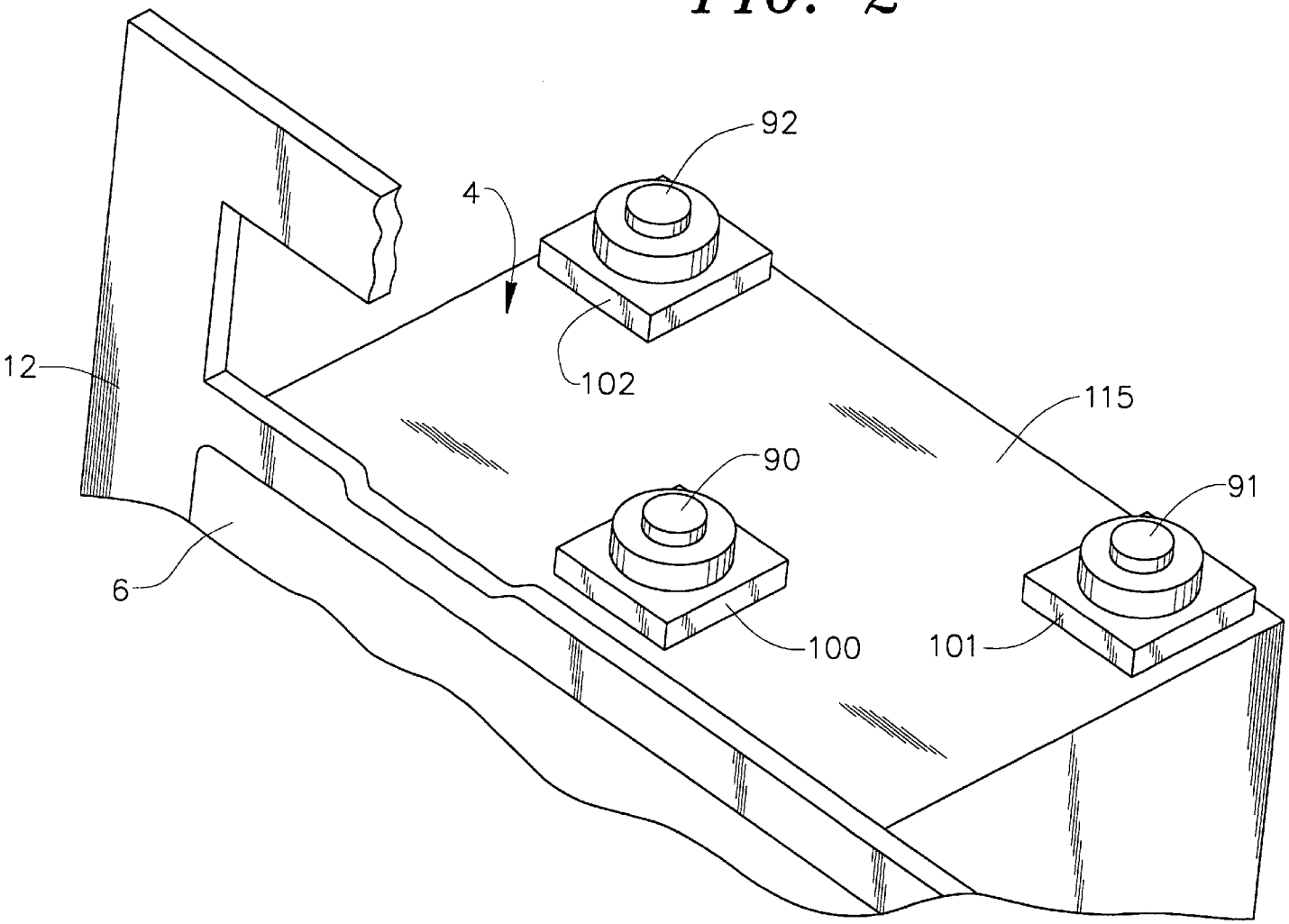
FIG. 2 is an upper perspective view of the multiple magnetrons of FIG. 1 mounted in accordance with a preferred embodiment of the present invention.

With reference to FIG. 2, each of the plurality of magnetrons 90–92 is preferably mounted to a respective simple waveguide 100–102. Preferably, waveguides 100–102 are arranged upon an upper surface 115 of upper oven 4. More specifically, each of the plurality of waveguides 100–102 includes a respective microwave transparent zone (not shown) at the interface with upper surface 115 of cooking cavity 6. In addition, a corresponding microwave transparent zone (not shown) is located on upper surface 115 directly below each of the plurality of waveguides 100–102. In this manner, upon activation of magnetrons 90–92, the microwave energy field emitted from each of the respective magnetrons 90–92 will pass through an insulation zone (not shown), upper portion 28, and into oven cavity 6.

In a preferred form of the invention, each of the plurality of magnetrons 90–92 are arranged along end or corner portions of oven cavity 6 at a defined distance or spaced relationship one from the other. In a more preferred form of the present invention, the distance between each of the respective plurality of magnetrons 90–92 is set to establish one-quarter wave multiples (¼λ), where λ is the wavelength of the microwave energy field emitted by the magnetrons. In one preferred form of the present invention, three 400-Watt magnetrons are arranged about oven cavity 6 such that the total energy delivered to oven cavity 6 will fall in the range of 1000–1200 watts.

Figure 3:
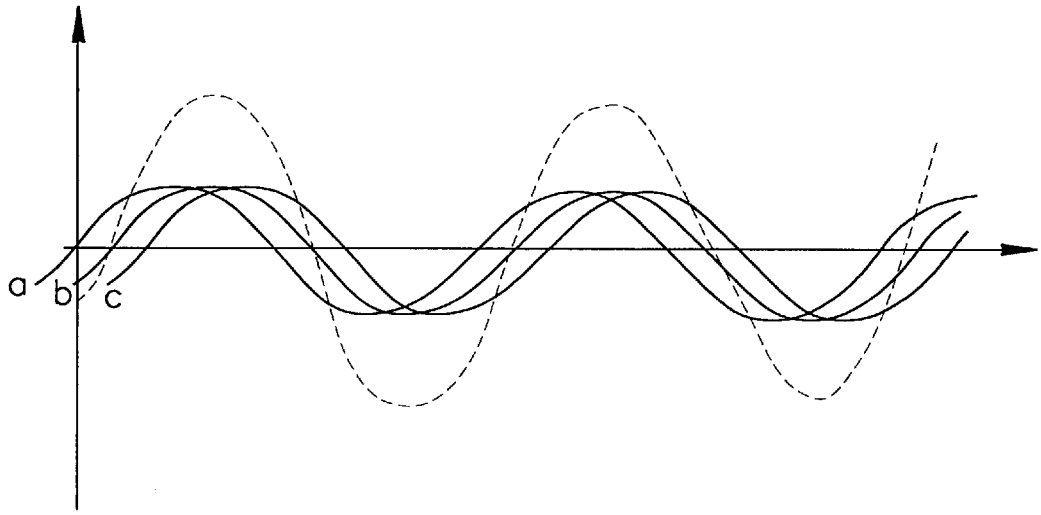
FIG. 3 is a graphical representation of the shifted and combined microwave energy field emitted by the multiple magnetrons of the invention.

Reference will now be made to FIGS. 1–3 is describing a preferred method of operation of cooking appliance 2. Upon selection of a desired microwave cooking process through operation of control elements 52, 53 and 55, each of the plurality of magnetrons 90–92 are activated. More specifically, magnetrons 90–92 are activated through electronic control unit 70 which independently controls the phase angle of the microwave energy fields a–c (see FIG. 3) emitted by the plurality of magnetrons 90–92. In a preferred form of the present invention, electronic control unit 70 establishes a difference between the phase angles for the microwave energy fields a–c emitted by magnetrons 90–92 in order that the energy fields a–c combine to establish total energy peaks which greatly exceed those of the individual energy fields as clearly represented in FIG. 3. In accordance with the invention, each of the microwave energy fields a–c enters oven cavity 6 through its associated waveguide 100–102 and subsequently impinges upon a food item such that the food item undergoes a cooking process. As each of the respective microwave energy fields are at a different phase angle, the food item is subjected to a constructive standing wave in a manner that substantially eliminates the presence of localized hot and cold areas.

In addition to eliminating the problem of uneven cooking created by localized hot and cold zones within oven cavity 6, the microwave delivery system of the present invention takes advantage of the additive qualities of the microwave energy fields. As such, the total energy delivered to oven cavity 6 is the combined energy level of the magnetrons. Therefore, as indicated above with reference to a preferred embodiment of the invention, three 400-Watt magnetrons would combine to deliver 1000–1200 Watts of energy at the peak of the resulting standing wave.

Although described with reference to a preferred embodiment of the invention, it should be readily understood that various changes and/or modifications can be made to the invention without departing from the spirit thereof. For instance, the mounting locations of each of the plurality of magnetrons can be varied. For example, one or more of the magnetrons can be arranged on side and/or rear portions of the oven cavity without departing from the scope of the present invention. In addition, the power output of the magnetrons can be adapted to serve various cooking applications such as suitable for domestic and/or commercial applications. In general, the invention is only intended to be limited by the scope of the following claims.

I claim:

1. A microwave cooking appliance comprising:

an oven cavity;

a plurality of microwave waveguides mounted to and opening into the oven cavity;

a plurality of magnetrons, each of said magnetrons being mounted to a respective one of said plurality of waveguides and adapted to transmit a respective microwave energy field through a respective said waveguide into the oven cavity; and an electronic control unit electrically connected to each of the plurality of magnetrons, said control unit being adapted to selectively operate each of the plurality of magnetrons such that a phase shift is produced between the microwave energy fields of the magnetrons, whereby the phase shift causes a combined constructive standing wave front to be established in the oven cavity.

2. The microwave cooking appliance according to claim 1, wherein the plurality of magnetrons are spaced from each other.

3. The microwave cooking appliance according to claim 2, wherein the plurality of magnetrons are spaced at distances equal to a multiple of ¼λ., wherein λ is a wavelength associated with each of the microwave energy fields.

4. The microwave cooking appliance according to claim 1, wherein the microwave energy fields of the plurality of magnetrons combine to form, a total microwave energy field greater than twice the microwave energy field of any individual one of the plurality of magnetrons.

5. The microwave cooking appliance according to claim 4, wherein the total microwave energy field is approximately 1000 to 1200 watts.

6. The microwave cooking appliance according to claim 1, wherein the oven cavity is void of a turntable.

7. The microwave cooking appliance according to claim 6, wherein the cooking appliance lacks a mode stirrer.

8. A microwave cooking appliance comprising:

an oven cavity;

a plurality of microwave waveguides mounted to and opening into the oven cavity;

a plurality of magnetrons, each of said magnetrons being mounted to a respective one of said plurality of waveguides and adapted to transmit a respective microwave energy field through a respective said waveguide into the oven cavity; and control means for selectively operating each of the plurality of magnetrons such that a phase shift is produced between each of the respective magnetrons, whereby the phase shift causes a combined constructive standing wave front to move about the oven cavity.

9. The microwave cooking appliance according to claim 8, wherein the control means comprises an electronic control unit electrically connected to each of the plurality of magnetrons.

10. The microwave cooking appliance according to claim 9, wherein the microwave energy fields of the plurality of magnetrons combine to form a total microwave energy field greater than twice the microwave energy field of any individual one of the plurality of magnetrons.

11. The microwave cooking appliance according to claim 8, wherein the plurality of magnetrons are spaced from each other.

12. The microwave cooking appliance according to claim 11, wherein the plurality of magnetrons are spaced at distances equal to a multiple of ¼λ., wherein λ is a wavelength associated with each of the microwave energy fields.

13. The microwave cooking appliance according to claim 8, wherein the oven cavity is void of a turntable.

14. The microwave cooking appliance according to claim 13, wherein the cooking appliance lacks a mode stirrer.

15. A method of cooking a food item in a microwave appliance including a plurality of magnetrons comprising:

placing a food item to be cooked within an oven cavity;

directing a plurality of microwave energy fields generated from the plurality of magnetrons into the oven cavity; and shifting relative phase angles of the microwave energy fields such that a combined constructive standing wave front is developed within the oven cavity for cooking the food item.

16. The method according to claim 15, further comprising: shifting the relative phase angles through an electronic control unit.

17. The method according to claim 15, further comprising: combining the microwave energy fields of the magnetrons such that a total, combined microwave energy field is introduced into the oven cavity and directed upon the food item.

18. The method according to claim 15, wherein the plurality of fields are directed into the oven cavity without being directed passed a mode stirrer.

19. The method according to claim 15, wherein the food item is maintained stationary during cooking in the oven cavity.

* * * * *